US008008864B2

(12) United States Patent
Nguyen et al.

(10) Patent No.: US 8,008,864 B2
(45) Date of Patent: Aug. 30, 2011

(54) SINGLE LED STRING LIGHTING

(75) Inventors: Chien Nguyen, Huntigton Beach, CA (US); Ekrem Cengelci, Garden Grove, CA (US); Mlchael Tran, Winnetka, CA (US)

(73) Assignee: Microsemi Corporation, Garden Grove, CA (US)

( * ) Notice: Subject to any disclaimer, the term of this patent is extended or adjusted under 35 U.S.C. 154(b) by 399 days.

(21) Appl. No.: 12/365,901

(22) Filed: Feb. 5, 2009

(65) Prior Publication Data

US 2009/0195163 A1 Aug. 6, 2009

Related U.S. Application Data

(60) Provisional application No. 61/026,581, filed on Feb. 6, 2008, provisional application No. 61/029,580, filed on Feb. 19, 2008.

(51) Int. Cl.
*H05B 37/00* (2006.01)

(52) U.S. Cl. ..... 315/122; 315/121; 315/123; 315/185 R

(58) Field of Classification Search ..... 315/121, 315/122, 123, 185 R; 345/102; 361/86
See application file for complete search history.

(56) References Cited

U.S. PATENT DOCUMENTS

| | | | | |
|---|---|---|---|---|
| 5,986,647 | A | 11/1999 | Feldman | |
| 6,127,783 | A | 10/2000 | Pashley | |
| 6,153,980 | A | 11/2000 | Marshall | |
| 6,194,839 | B1 | 2/2001 | Chang | |
| 6,201,353 | B1 | 3/2001 | Chang | |
| 6,441,558 | B1 | 8/2002 | Muthu | |
| 6,521,879 | B1 | 2/2003 | Rand et al. | |
| 7,629,751 | B2 * | 12/2009 | Chou et al. | 315/123 |
| 7,663,598 | B2 * | 2/2010 | Kim | 345/102 |
| 7,791,584 | B2 * | 9/2010 | Korcharz et al. | 345/101 |
| 7,800,876 | B2 * | 9/2010 | Peker et al. | 361/86 |
| 7,847,783 | B2 * | 12/2010 | Liu et al. | 345/102 |
| 2002/0043943 | A1 | 4/2002 | Menzer | |
| 2002/0130786 | A1 * | 9/2002 | Weindorf | 340/815.45 |
| 2004/0036629 | A1 * | 2/2004 | Jones et al. | 340/908 |
| 2004/0135522 | A1 | 7/2004 | Berman | |
| 2005/0212459 | A1 | 9/2005 | Patel et al. | |
| 2005/0231127 | A1 | 10/2005 | Yamamoto et al. | |
| 2005/0231459 | A1 | 10/2005 | Furukawa | |
| 2005/0259439 | A1 | 11/2005 | Cull | |
| 2006/0007097 | A1 | 1/2006 | Ichikawa | |
| 2006/0007103 | A1 | 1/2006 | Oh et al. | |

(Continued)

OTHER PUBLICATIONS

Chen et al, LED Back-Light Driving System for LCD Panels, Applied Power Electronics Conferences and Exposition, 2006, Published Mar. 19-23, 2006, IEEE New York.

*Primary Examiner* — Shawki Ismail
*Assistant Examiner* — Thienvu Tran
(74) *Attorney, Agent, or Firm* — Simon Kahn

(57) ABSTRACT

A solid state lighting unit constituted of: a control circuitry; a single string of light emitting diodes, the single string constituted of a plurality of sections each comprising a plurality of light emitting diodes; and a plurality of bypass paths each responsive to the control circuitry, each of the plurality of bypass paths arranged to provide bypass to a particular one of the plurality of sections, wherein the control circuitry is operative to identify an open circuit condition of a particular one of the plurality of sections, and activate the bypass path arranged to bypass the open circuit section, thereby providing light through sections not exhibiting an open circuit condition.

10 Claims, 5 Drawing Sheets

U.S. PATENT DOCUMENTS

2006/0007110 A1 1/2006 Hung
2006/0007112 A1 1/2006 Park
2006/0108933 A1 5/2006 Chen
2007/0046485 A1 3/2007 Grootes
2007/0080911 A1* 4/2007 Liu et al. ..... 345/82
2007/0097463 A1* 5/2007 Razavi ..... 358/509
2007/0159750 A1* 7/2007 Peker et al. ..... 361/93.1
2007/0195025 A1 8/2007 Korcharz
2008/0049475 A1* 2/2008 Watanabe et al. ..... 363/127
2008/0100561 A1* 5/2008 Price et al. ..... 345/102
2008/0106505 A1* 5/2008 Chou ..... 345/83
2009/0195163 A1* 8/2009 Nguyen et al. ..... 315/122
2010/0019693 A1* 1/2010 Hoogzaad et al. ..... 315/294
2011/0074839 A1* 3/2011 Liu et al. ..... 345/690

* cited by examiner

SINGLE LED STRING LIGHTING

CROSS-REFERENCE TO RELATED APPLICATIONS

This application claims priority from U.S. Provisional Patent Application Ser. No. 61/026,581 filed Feb. 6, 2008 and Ser. No. 61/029,580 filed Feb. 19, 2008, each entitled "Single LED String Backlit Portable Computer", the entire contents of both of which is incorporated herein by reference.

BACKGROUND OF THE INVENTION

The present invention relates to the field of solid state lighting, and in particular to a LED string constituted of a plurality of serially connected LED strings, each provided with a controlled bypass path.

Light emitting diodes (LEDs) and in particular high intensity and medium intensity LED strings are rapidly coming into wide use for lighting applications. LEDs with an overall high luminance are useful in a number of applications including backlighting for liquid crystal display (LCD) based monitors and televisions, collectively hereinafter referred to as a matrix display, as well as for general lighting applications.

In a large LCD matrix display, and in large solid state lighting applications, such as street lighting, typically the LEDs are supplied in a plurality of strings of serially connected LEDs, at least in part so that in the event of failure of one string at least some light is still output. The constituent LEDs of each LED string thus share a common current.

In order to supply a white backlight for the matrix display one of two basic techniques are commonly used. In a first technique strings of "white" LEDs are utilized, the white LEDs typically comprising a blue LED with a phosphor which absorbs the blue light emitted by the LED and emits a white light. In a second technique individual strings of colored LEDs are placed in proximity so that in combination their light is seen a white light. Often, two strings of green LEDs are utilized to balance each single red and blue LED string.

In either of the two techniques, the strings of LEDs are in one embodiment located at one end or one side of the matrix display, the light being diffused to appear behind the LCD by a diffuser. In another embodiment the LEDs are located directly behind the LCD, the light being diffused by a diffuser so as to avoid hot spots. In the case of colored LEDs, a further mixer is required, which may be part of the diffuser, to ensure that the light of the colored LEDs is not viewed separately, but rather mixed to give a white light. The white point of the light is an important factor to control, and much effort in design in manufacturing is centered on the need to maintain a correct white point in the event that colored LEDs are utilized.

LEDs providing high luminance exhibit a range of forward voltage drops, denoted $V_f$, and their luminance is primarily a function of current. For example, one manufacturer of LEDs suitable for use with a portable computer, such as a notebook computer, indicates that $V_f$ for a particular high luminance white LED ranges from 2.95 volts to 3.65 volts at 20 mA and an LED junction temperature of 25° C., thus exhibiting a variance in $V_f$ of greater than ±10%. Furthermore, the luminance of the LEDs vary as a function of junction temperature and age, typically exhibiting a reduced luminance as a function of current with increasing temperature and increasing age. In order to provide backlight illumination for a portable computer with an LCD matrix display of at least 25 cm measured diagonally, at least 20, and typically in excess of 40, LEDs are required. In order to provide street lighting, in certain applications over 100 LEDs are required.

In order to provide a balanced overall luminance, it is important to control the current of the various LED strings to be approximately equal. In one embodiment, as described in U.S. patent application Ser. No. 11/676,313 to Korcharz et al, entitled "Voltage Controlled Backlight Driver", filed Feb. 19, 2007 and published as US 2007/0195025 Aug. 23, 2007, the entire contents of which is incorporated herein by reference, this is accomplished by a controlled dissipative element placed in series with each of the LED strings. In another embodiment, binning is required, in which LEDs are sorted, or binned, based on their electrical and optical characteristics. Thus, in order to operate a plurality of like colored LED strings from a single power source, at a common current, either binning of the LEDs to be within a predetermined range of $V_f$ is required, or a dissipative element must be supplied to drop the voltage difference between the strings caused by the differing $V_f$ values so as to produce an equal current through each of the LED strings. Either of these solutions adds to cost and/or wasted energy. In order to utilize a plurality of colored LED strings mixed to provide a white light a color manager is further required, which yet further adds to cost.

Portable computers typically exhibit a large range of available input voltages. For example, when operating from battery power, the portable computer must be operative when the battery output has declined to approximately 5.5 volts. When connected to an AC mains via a power adapter, the portable computer must be operative for voltages well in excess of the lowest battery voltage, typically up to 28V DC. Thus, any solution must be operative over a wide input voltage range.

Prior art portable computers with an LCD matrix display of greater than 25 cm diagonally measured exhibit a plurality of short LED strings. Each LED string requires a maximum voltage of typically no more than 60 volts DC. Such a voltage is easily generated from the wide ranging DC input source, however to achieve a substantially uniform backlight one of the binning and the dissipative solution described above is required.

SUMMARY OF THE INVENTION

Accordingly, it is a principal object of the present invention to overcome at least some of the disadvantages of the prior art. This is provided in certain embodiments by a solid state lighting unit exhibiting a single LED string constituted of a plurality of sections, each constituted of a plurality of LEDs. A bypass path is provided for each of the sections, and a control circuitry monitors operation of the single LED string. In the event that one of the sections exhibits an open condition, the section is bypassed thereby providing for uninterrupted lighting.

In one embodiment, the solid state lighting unit provides backlighting for a portable computer exhibiting an LCD matrix display of at least 25 cm measured diagonally. Arranging all of the LED's in a single string advantageously eliminates the need to match the LED currents between multiple strings.

In one embodiment, the single string of LEDs is driven by a boost converter exhibiting a secondary winding magnetically coupled to the inductor of the boost converter. The secondary winding provides a high voltage suitable for driving the single LED string at voltages greater than about 80 volts DC in a single stage from the varying input voltage of 5.5 volt to 28 volts DC. In another embodiment a boost converter implemented as a flyback is provided.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
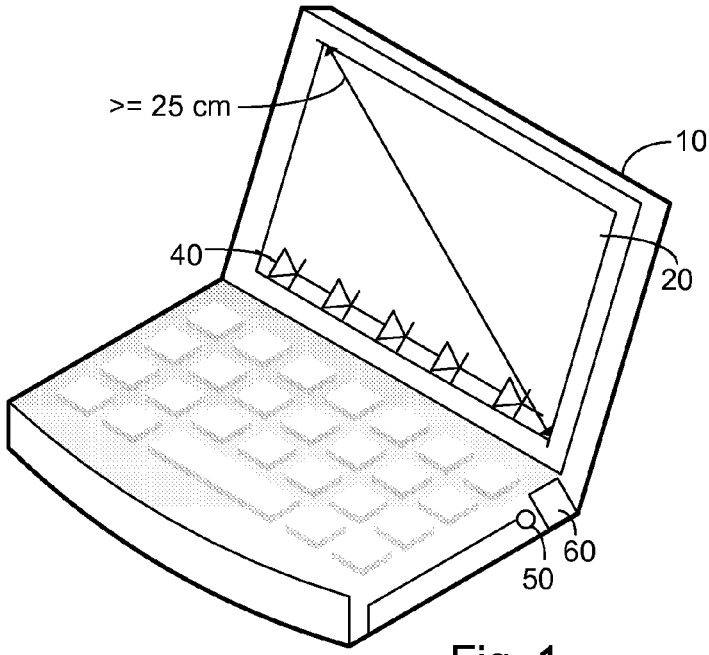
FIG. 1 illustrates an exemplary embodiment of a portable computer exhibiting a solid state lighting unit constituted of a single LED string.

Certain embodiments enable a solid state lighting unit exhibiting a single LED string constituted of a plurality of sections, each constituted of a plurality of LEDs. A bypass path is provided for each of the sections, and a control circuitry monitors operation of the single LED string. In the event that one of the sections exhibits an open condition, the section is bypassed thereby providing for uninterrupted lighting.

In one embodiment, the solid state lighting unit provides backlighting for a portable computer exhibiting an LCD matrix display of at least 25 cm measured diagonally. Arranging all of the LEDs in a single string advantageously eliminates the need to match the LED currents between multiple strings.

In one embodiment, the single string of LEDs is driven by a boost converter exhibiting a secondary winding magnetically coupled to the inductor of the boost converter. The secondary winding provides a high voltage suitable for driving the single LED string at voltages greater than about 80 volts DC in a single stage from the varying input voltage of 5.5 volt to 28 volts DC. In another embodiment a boost converter implemented as a flyback is provided.

The detailed implementation will be described in relation to a portable computer exhibiting a display of at least 25 cm measured diagonally, however this is not meant to be limiting in any way. The techniques described herein are equally applicable to other solid state lighting applications, including without limitation, street lighting.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 illustrates a portable computer 10 exhibiting a liquid crystal display 20 with a minimum diagonal dimension of 25 centimeters, the liquid crystal being viewable in cooperation with a backlight. The liquid crystal display is preferably a matrix display and is denoted herein as exhibiting a minimum diagonal dimension because the requirements of high voltage are not experienced with screens substantially smaller than 25 cm. Backlighting for portable computer 10 is provided by a single string 40 of LEDs as will be described further hereinto below, wherein the LEDs are preferably white light LEDs. Single string 40 is shown situated across the bottom of liquid crystal display 20 however this is not meant to be limiting in any way. In another embodiment single string 40 is situated along one side, across the top, or arranged in a matrix across the back of liquid crystal display 20, without exceeding the scope of the invention. Portable computer 10 further exhibits a jack 50 for receipt of power converted from an AC mains and a battery 60 for operation in the absence of the AC mains power.

Figure 2:
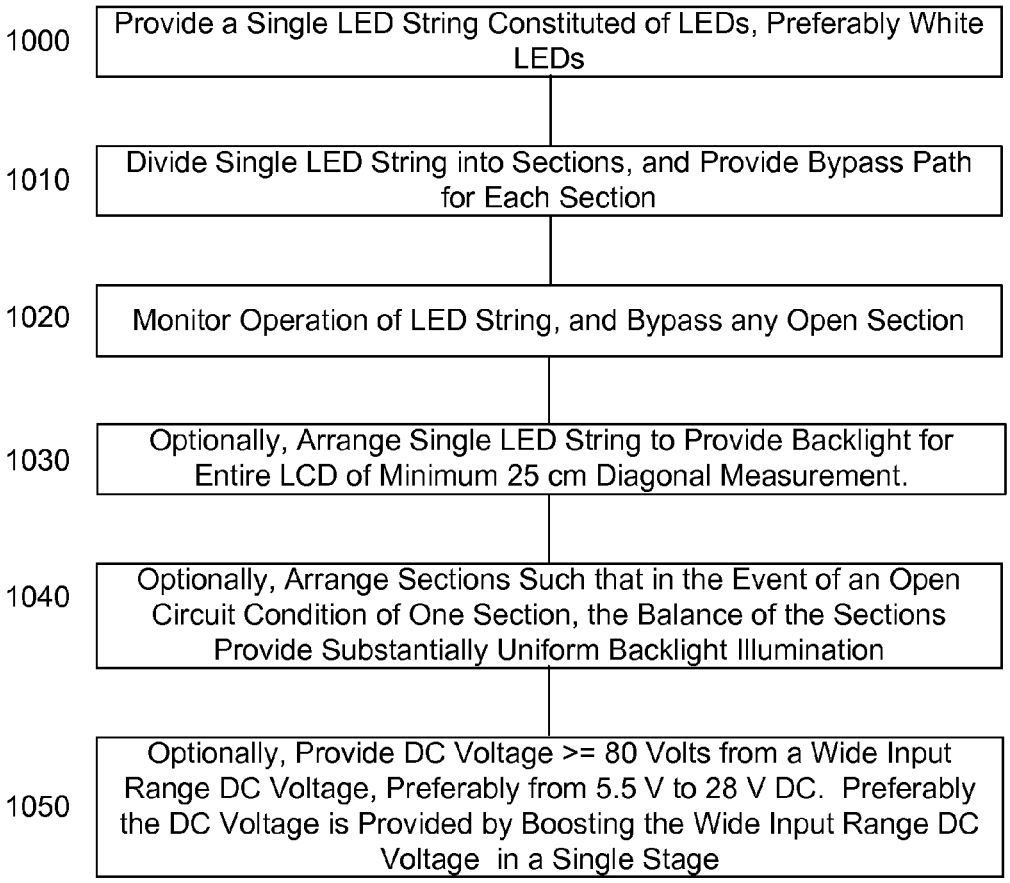
FIG. 2 illustrates a high level flow chart of an embodiment of a method of providing solid state lighting.

FIG. 2 illustrates a high level flow chart of an embodiment of a method for solid state illumination. In stage 1000, a single string of LEDs, such as string 40 of FIG. 1 is provided. Preferably, the single string of LEDs is constituted of white LEDs. In stage 1010, the single string of white LEDs is divided into sections, and a bypass path is provided for each section such that in the event of an open circuit condition for any LED in the section, the balance of the sections of the single string continues to conduct current and provide illumination. Such a bypass path is described in U.S. patent application Ser. No. 11/620,753 to Peker et al, filed Jan. 8, 2007, entitled "Fault Detection Mechanism for LED Backlighting" and published as U.S. Patent Application Publication S/N 2007/0159750 A1 Jul. 12, 2007, the entire contents of which is incorporated herein by reference, and in relation to FIGS. 3-6 below. Optionally, the bypass path of the current application is arranged to bypass a plurality of LEDs, defined as an LED section, and is not arranged to bypass individual LEDs.

In stage 1020, the provided LED string of stage 1000, or the operation of the individual sections of stage 1010 are monitored. In the event that any of the sections exhibit a failure, such as an open circuit condition, the respective failed section is bypassed by the provided bypass path of stage 1010.

In optional stage 1030, the provided single string of LEDs is arranged to provide a substantially uniform backlight for the entire liquid crystal display 20 exhibiting a minimum diagonal dimension of 25 cm.

In optional stage 1040, the sections of the single string of stages 1000 and 1010 are arranged such that in the event of an open circuit condition for one of the sections, the balance of the sections continue to provide a substantially uniform backlight.

In optional stage 1050, a DC voltage greater than or equal to 80 volts is provided to drive the single string of stage 1000, the DC voltage being provided responsive to a wide ranging input DC voltage. Preferably the wide ranging input DC voltage is from 5.5 volts to 28 volts. In a preferred embodiment, the DC voltage greater than or equal to 80 volts is provided by boosting the wide ranging input DC voltage in a single stage as will be described further hereinto below in relation to FIGS. 3-6.

Figure 3:
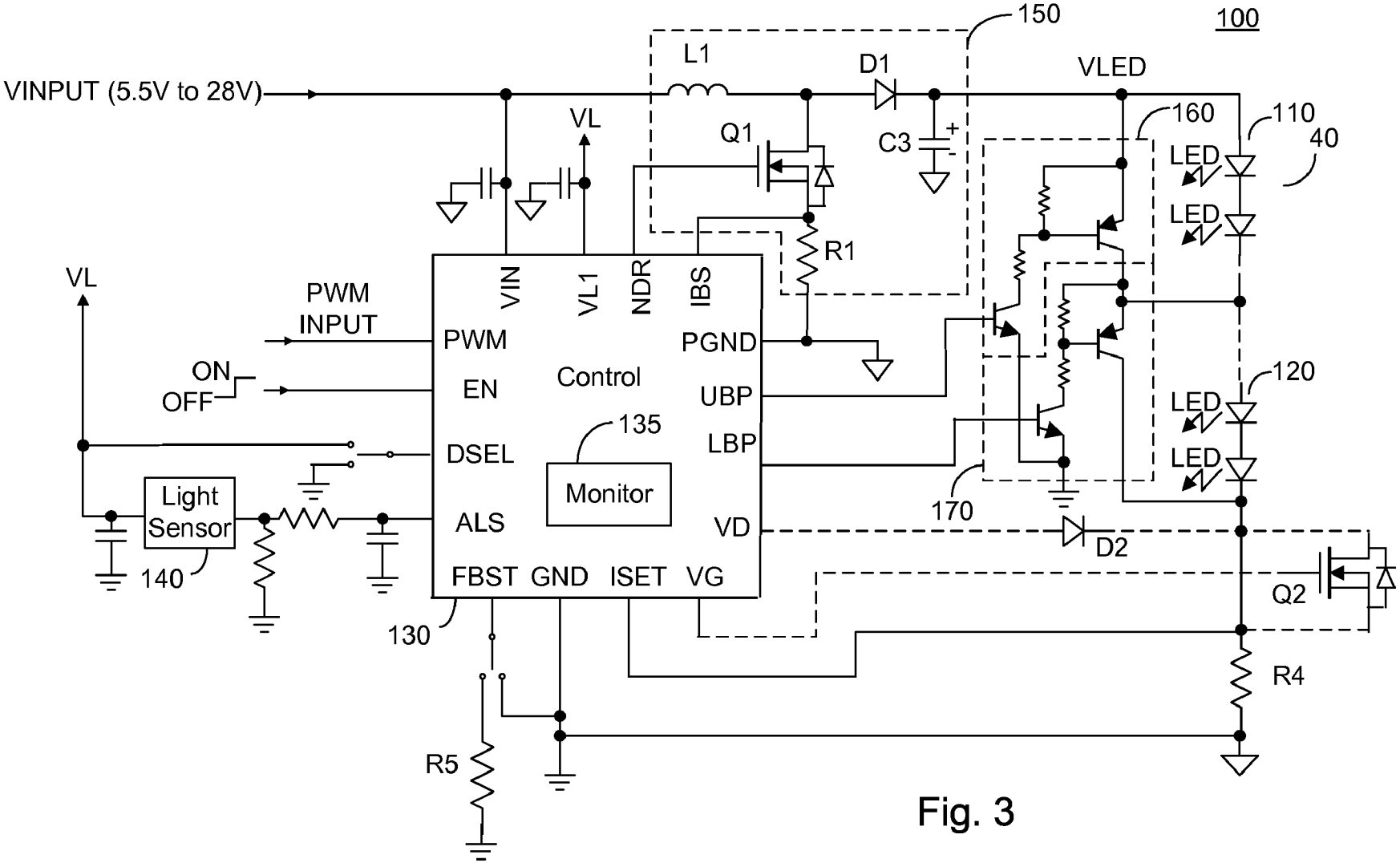
FIG. 3 illustrates a high level schematic diagram of an exemplary embodiment of a solid state lighting arrangement in which bypass paths and a conventional boost converter switch are external of the boost control circuitry.

FIG. 3 illustrates a high level schematic diagram of an embodiment of a solid state lighting arrangement 100 in which bypass paths and a conventional boost converter switch are external of a boost control circuitry 130. Solid state lighting arrangement 100 comprises: a single string 40 of white LEDs divided into a first section 110 and a second section 120; boost control circuitry 130 comprising a monitoring functionality 135; an ambient light sensor 140; a boost converter 150; a first bypass path 160; a second bypass path 170; an optional PWM switch Q2; an optional diode D2; and a sense resistor R4. Boost converter 150 comprises: a boost converter switch Q1; a sense resistor R1; an inductor L1; a diode D1; and an output capacitor C3. First bypass path 160 comprises a pair of bipolar transistors and a pair of resistors. Second bypass path 170 comprises a pair of bipolar transistors and a pair of resistors. Single string 40 is shown as being constituted of two sections however this is not meant to be limiting in any way, and more than two sections may be implemented without exceeding the scope of the invention. Preferably, for each section, a respective bypass path is provided.

Ambient light sensor 140 is connected to an input of control circuitry 130, denoted ALS, via a resistor divider network and a smoothing capacitor, and arranged to receive ambient light. Ambient light sensor 140 is further connected to a voltage source, denoted VL. A first end of inductor L1 of boost converter 150 is operatively connected to a wide ranging DC input source, denoted VINPUT and to an input of control circuitry 130, denoted VIN. In one embodiment the wide ranging DC input source varies from 5.5 volts DC to 28 volts DC. A second end of inductor L1 is connected to a first terminal of boost converter switch Q1 and to the anode of diode D1. The second terminal of boost converter switch Q1 is connected to a sense input of control circuitry 130, denoted IBS, and to a first end of resistor R1. The control terminal of boost converter switch Q1 is connected to an output of control circuitry 130, denoted NDR. Boost converter switch Q1 is illustrated as a MOSFET, and in particular an NMOSFET, however this is not meant to be limiting in any way. A second end of resistor R1 is connected to a common terminal, and to a common reference terminal of control circuitry 130, denoted PGND. The cathode of diode D1 is connected to a first end of capacitor C3 and represents the output of boost converter 150, denoted $V_{LED}$, and is operatively connected to a first end of single string 40 of white LEDs.

First bypass path 160 comprises a pair of bipolar transistors, particularly a PNP transistor and an NPN transistor arranged across first section 110 of single string 40. Second bypass path 170 comprises a pair of bipolar transistors, particularly a PNP transistor and an NPN transistor arranged across second section 120 of single string 40. Solid state lighting arrangement 100 is illustrated with bipolar transistors, however this is not meant to be limiting in any way. In another embodiment, the bypass paths are implemented with MOSFETs, or other elements as described in U.S. patent application Ser. No. 11/620,753 to Peker et al, filed Jan. 8, 2007, entitled "Fault Detection Mechanism for LED Backlighting" incorporated above by reference. A first end of sense resistor R4 is connected to the second end of single string 40 and to a current sensing input of control circuitry 130, denoted ISET, and a second end of sense resistor R4 is connected to a common point, illustrated without limitation as ground. Optional PWM switch Q2 is arranged in series with single string 40, preferably placed between the end of second section 120 of single string 40 and sense resistor R4, with its control terminal connected to an output of control circuitry 130, denoted VG, and is arranged to conduct current through single string 40 when closed, and interrupt the flow of current through single string 40 when opened. In the event that optional PWM switch Q2 is implemented, the second end of single string 40 is preferably connected to a voltage sensing input of control circuitry 130, denoted VD via optional diode D2, which enables measurement of the voltage drop across PWM switch Q2.

An input of control circuitry 130, denoted DSEL is switchably connected to one of voltage source VL and ground. An input of control circuitry 130, denoted FBST is switchably connected to one of a direct connection to ground and a connection to ground via a resistor, R5. A PWM input signal is provided to control circuitry 130 via an input denoted PWM, and an enable input signal is provided to control circuitry 130 via an input denoted EN. A terminal denoted GND is further provided connected to the common point, and a terminal denoted VL1 is provided connected voltage source VL.

In operation, boost converter 150 boosts the wide ranging input DC voltage responsive to control circuitry 130, with the current through boost converter switch Q1 being sensed by the voltage drop across resistor R1. Output $V_{LED}$ of boost converter 150 is preferably greater than or equal to 80 volts DC. In one embodiment $V_{LED}$ is 180 to 210 volts DC. The current through single string 40 is sensed via sense resistor R4 and compared to a reference voltage. In one embodiment the difference is amplified and used to adjust the duty ratio, or on time, of boost converter switch Q1 so as to maintain a constant current through single string 40. In another embodiment, the amplified difference is used to control the current through single string 40 by regulating the current passing through Q2, i.e. dissipating any excess current via the controlled resistance of Q2. In such an embodiment, the duty cycle of boost converter 150 is controlled by a separate control loop responsive to the voltage sensed at the drain of Q2 via diode D2. The frequency of operation of boost converter switch Q1 is controlled responsive to the value of resistor R5 connected to FBST. The value of the constant current through single string 40 is variable responsive the output of ambient light sensor 140 via the ALS input. Control circuitry 130 is active responsive to a positive input at the EN input and is further active responsive to an input received at the PWM input to open and close PWM switch Q2.

Monitoring functionality 135 of control circuitry 130 is further active to monitor the current flow through sense resistor R4, and in the event that the current flow falls below a predetermined minimum, to detect that an open circuit condition exists in one of first section 110 and second section 120 of single string 40. Responsive to the detected open circuit condition, control circuitry 130 operates alternatively first bypass path 160 and second bypass path 170 so as to enable current flow to bypass the section exhibiting the open circuit condition thereby enabling current flow through sense resistor R4 via the remaining functioning section of single string 40. First bypass path 160 is arranged to conduct current across first section 110 responsive to an output of control circuitry 130, denoted UBP, the current being conducted with a minimal voltage drop across the PNP transistor of first bypass path 160 responsive to the conduction of the NPN transistor of first bypass path 160. Second bypass path 170 is arranged to conduct current across second section 120 responsive to an output of control circuitry 130, denoted LBP, the current being conducted with a minimal voltage drop across the PNP transistor of second bypass path 170 responsive to the conduction of the NPN transistor of second bypass path 170. As described above, in another embodiment the bipolar transistors of first and second bypass paths 160, 170 are replaced with FETs, and particularly MOSFETs without exceeding the scope of the invention.

The above has been described in relation to providing active bypass paths operative under control of control circuitry 130, however this is not meant to be limiting in any way. In an alternative embodiment a passive bypass path is provided as described in U.S. patent application Ser. No. 11/620,753 to Peker et al, filed Jan. 8, 2007, entitled "Fault Detection Mechanism for LED Backlighting" and published as U.S. Patent Application Publication S/N 2007/0159750 A1 Jul. 12, 2007, incorporated above.

Figure 4:
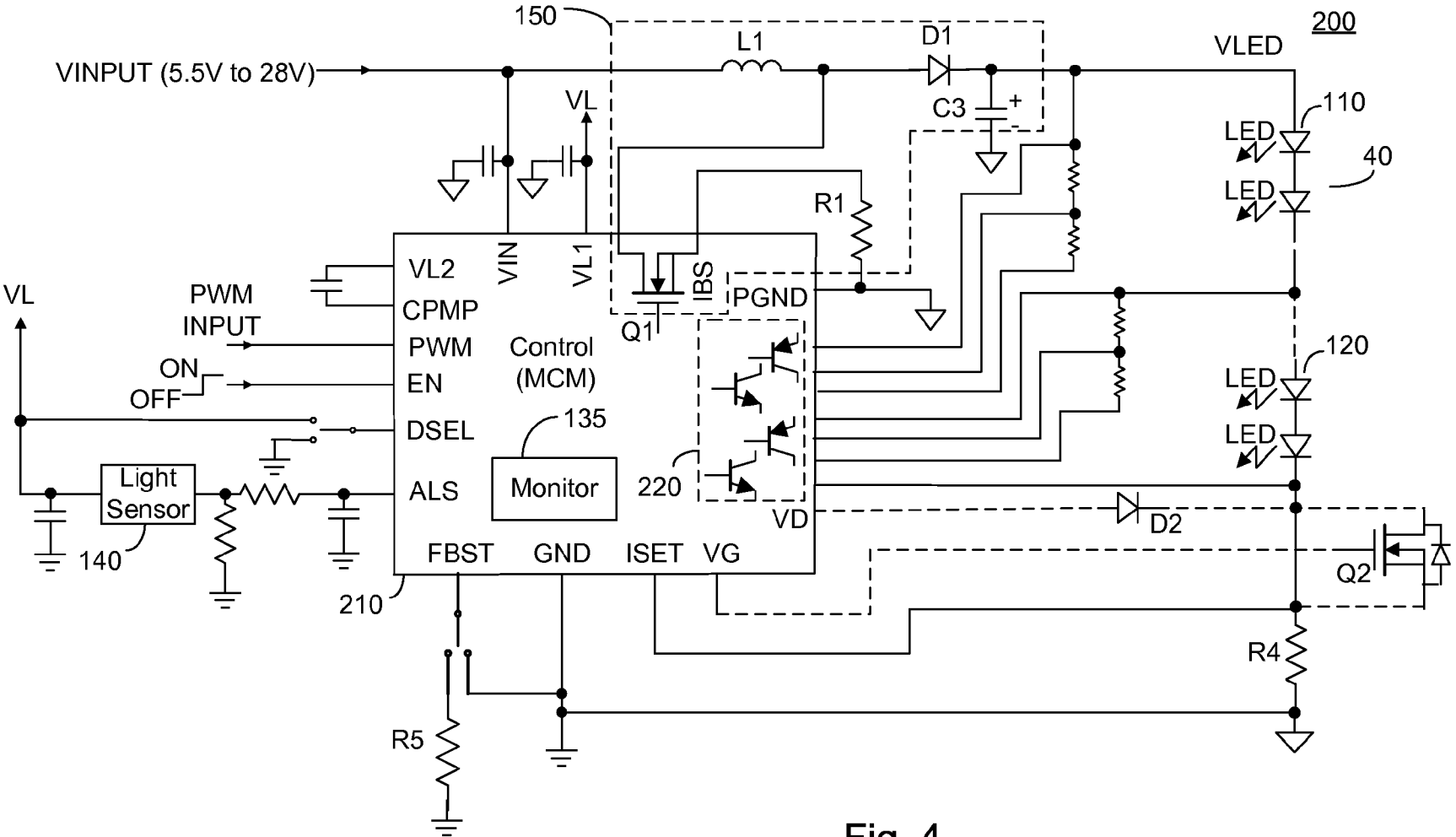
FIG. 4 illustrates a high level schematic diagram of an exemplary embodiment of a solid state lighting arrangement in which bypass paths and a conventional boost converter switch are internal to the boost control circuitry.

FIG. 4 illustrates a high level schematic diagram of an embodiment of a solid state lighting arrangement 200 in which the transistors of bypass paths 160 and 170 of FIG. 3, illustrated as a bypass transistor block 220, and the boost converter switch Q1 of FIG. 3, are internal to a control circuitry 210, preferably in a multi-chip module. Control circuitry 210 thus requires a high voltage switch Q1, preferably on the order of 250 volts, and high voltage bypass transistors constituting bypass transistor block 220, preferably on the order of 250 volts. As described above, bypass transistor block 220 may be comprised of bipolar transistors, FETs or MOSFETs without exceeding the scope of the invention. Solid state lighting arrangement 200 is in all respects similar to solid state lighting arrangement 100, and the operation of solid state lighting arrangement 200 is in all respects similar to the operation of solid state lighting arrangement 100.

Figure 5:
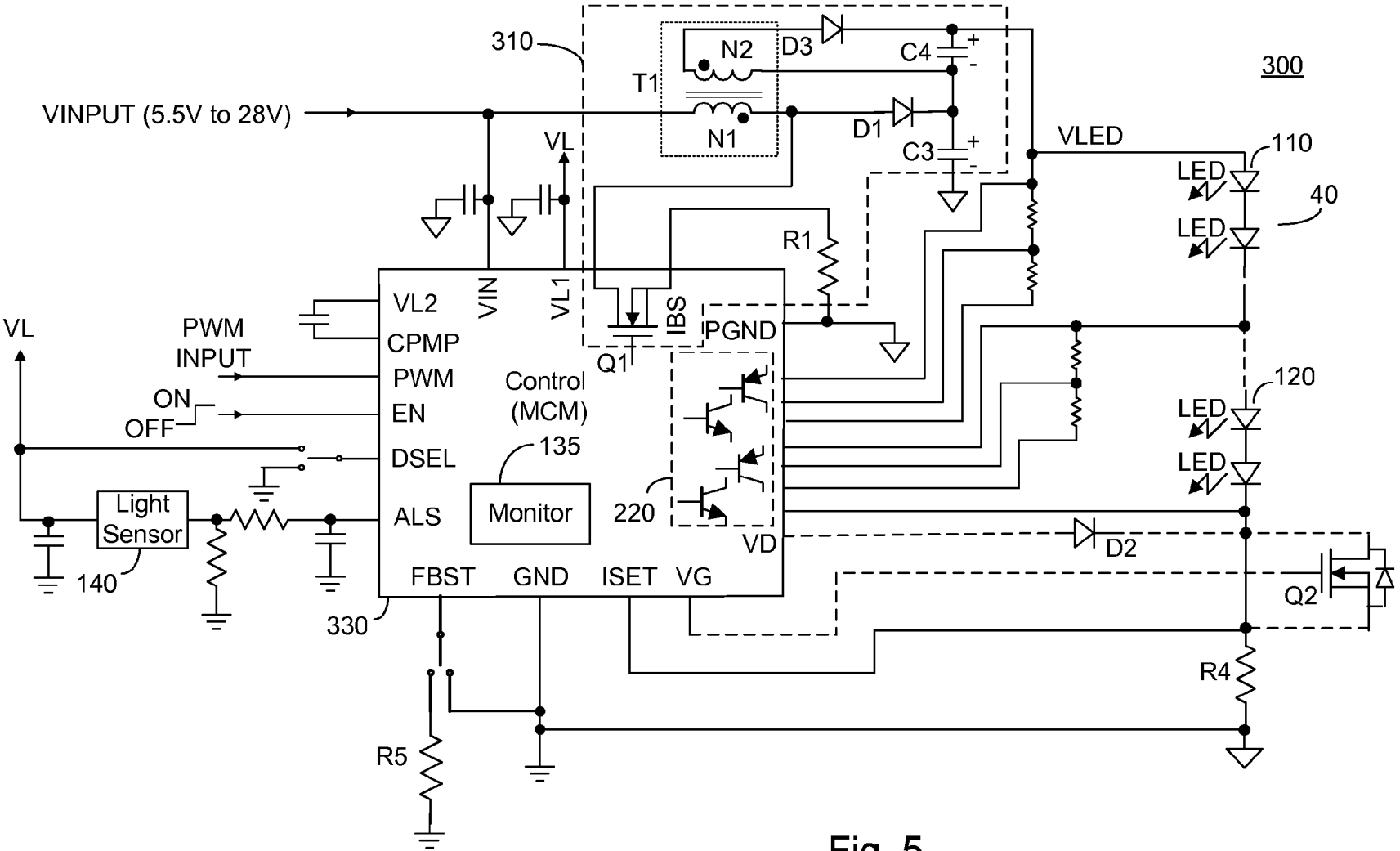
FIG. 5 illustrates a high level schematic diagram of an exemplary embodiment of a solid state lighting arrangement in which the boost converter inductor exhibits a secondary winding.

FIG. 5 illustrates a high level schematic diagram of an embodiment of a solid state lighting arrangement 300 in which the inductor of a boost converter 310 exhibits a secondary winding. With the exception of the differences between boost converter 150 of FIGS. 3 and 4, and boost converter 310, which will be detailed below, solid state lighting arrangement 300 is in all respects similar to solid state lighting arrangement 200, and the operation of solid state lighting arrangement 300 is in all respects similar to the operation of solid state lighting arrangement 200. Boost converter 310 comprises: a two-winding inductor forming a transformer T1 with winding turn numbers of N1 and N2; a first diode D1; a second diode D3; a first output capacitor C3; a second output capacitor C4; a sense resistor R1 and a boost converter switch Q1, located within a control circuitry 330. The winding of T1 with turns N1 is referred to as the primary winding and the winding of T1 with turns N2 is referred to as the secondary winding.

A first end of the primary winding of transformer T1 of boost converter 310 is operatively connected to a wide ranging DC input source. In one embodiment the wide ranging DC input source varies from 5.5 volts DC to 28 volts DC. A second end of the primary winding of transformer T1 is connected to a first terminal of boost converter switch Q1 located within a control circuitry 330 and to the anode of first diode D1. The second terminal of boost converter switch Q1 is connected to a sense input of control circuitry 330, denoted IBS, and to a first end of resistor R1. The control terminal of boost converter switch Q1 is internally connected to an output of the logic of control circuitry 330 (not shown). Boost converter switch Q1 is illustrated as a MOSFET, an in particular an NMOSFET, however this is not meant to be limiting in any way, and boost converter switch may be implemented with a bipolar transistor arrangement, a FET, or a PMOSFET without exceeding the scope of the invention. A second end of resistor R1 is connected to a common terminal, and to a common reference terminal input of control circuitry 330, denoted PGND. The cathode of D1 is connected to a first end of first output capacitor C3, a first end of the secondary winding of transformer T1 and a first end of second output capacitor C4. The second end of first capacitor C3 is connected to the common terminal. The second end of the secondary winding of transformer T1 is connected to the anode of second diode D3. The cathode of second diode D3 represents the output of boost converter 330, denoted $V_{LED}$, and is operatively connected to a first end of single string 40 of white LEDs and to the second end of second output capacitor C4. The primary and secondary windings of transformer T1 are magnetically coupled with their polarity arranged such that when switch Q1 is closed, the first winding of transformer T1 (with N1 turns) has negative voltage at its terminal connected to switch Q1 with respect to its other terminal while the second winding of transformer T1 (with N2 turns) has a positive voltage at its terminal connected to C3 with respect to its other terminal.

In operation, when boost converter switch Q1 is closed, current flows through the primary winding of transformer T1 and through boost converter switch Q1 to ground, or the common terminal. During this time interval, diodes D1 and D3 are reverse biased and do not carry current. When boost converter switch Q1 opens, diodes D1 and D3 are forward biased and conduct charging capacitors C3 and C4, respectively. Voltage $V_{LED}$ represents the sum of the voltages across first output capacitor C3 and second output capacitor C4. Let the DC voltages across capacitors C3 and C4 be denoted as $V_{C3}$ and $V_{C4}$, respectively. $V_{C3}$ and $V_{C4}$ can be formulated as follows, where N represents N2/N1:

$$V_{C3} = \frac{V_{LED} + N \cdot VIN}{1 + N} \quad \text{EQ. 1}$$

$$V_{C4} = \frac{N}{1 + N}(V_{LED} - VIN) \quad \text{EQ. 2}$$

Average current through diodes D1 and D3 are the same and equal to the LED string current. The DC reverse blocking voltages of boost converter switch Q1 and diode D1 are the same and equal to $V_{C3}$. The reverse blocking voltages of boost converter switch Q1, diode D1 and diode D3, denoted respectively $V_{Q1}$, $V_{D1}$ and $V_{D3}$, are formulated as below.

$$V_{D1}=V_{Q1}=V_{C3} \quad \text{EQ 3}$$

$V_{C3}$ in EQ 3 is as given in EQ 1.

$$V_{D3} = \frac{N}{1 + N}(V_{LED} + N \cdot VIN) \quad \text{EQ 4}$$

Resistor R1 provides current limit protection for boost converter switch Q1, and current sensing for current through boost converter switch Q1 in the event that the on-time of boost converter switch Q1 is controlled by current mode control.

By choosing the ratio of N2/N1 to be higher than 1, advantageously arrangement 300 does not require a high voltage boost converter switch Q1, thereby reducing cost. The voltage across Q1 is limited to less than about 60 volts. It is to be understood that Q1 and the transistors of bypass paths 160 and 170, illustrated as a bipolar transistor block 220 may be within the control circuitry 330, as a high voltage bipolar block, or external to control circuitry 330 as described above in relation to arrangement 100 of FIG. 3.

Figure 6:
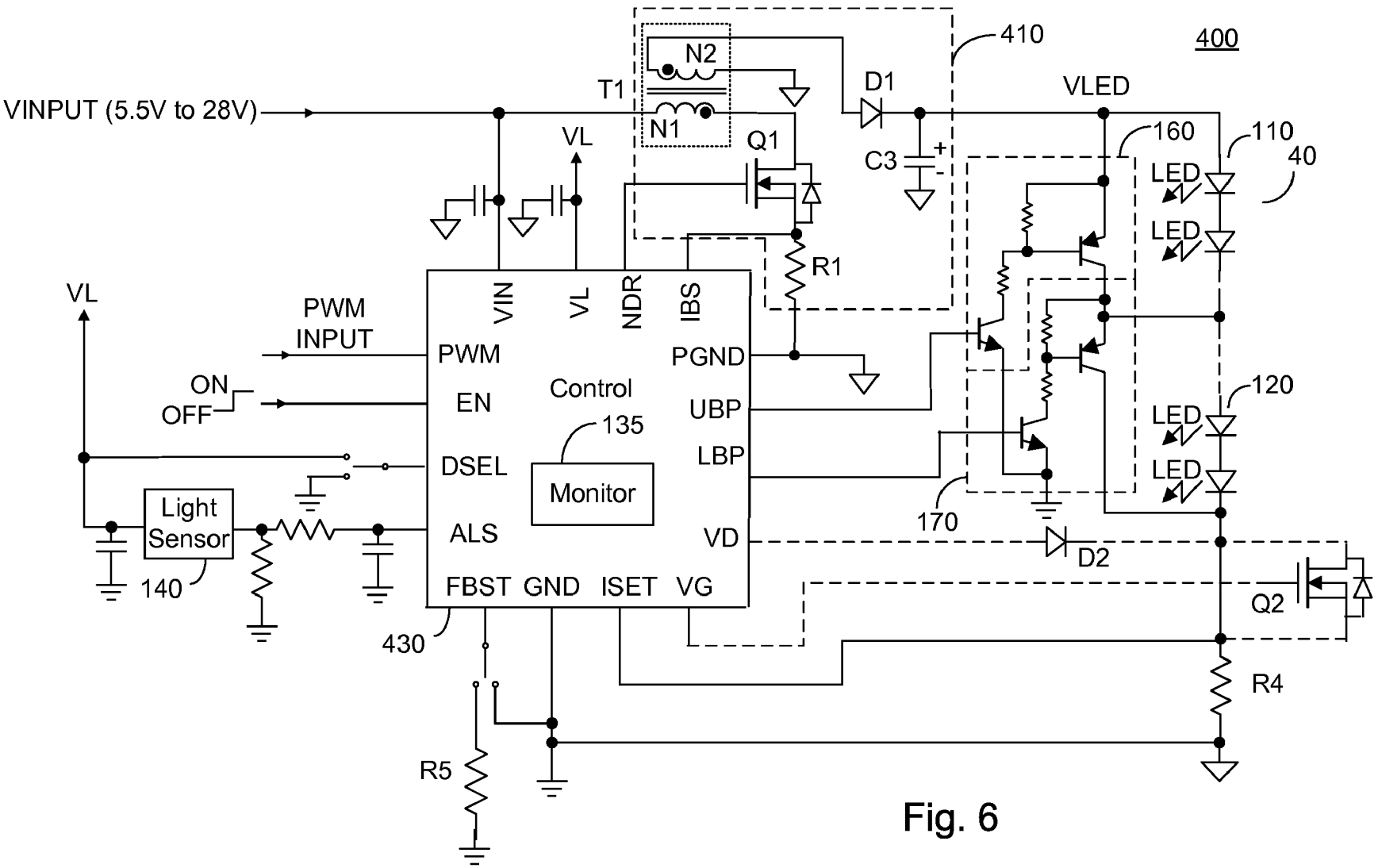
FIG. 6 illustrates a high level schematic diagram of an exemplary embodiment of a solid state lighting arrangement comprising a flyback converter.

FIG. 6 illustrates a high level schematic diagram of an embodiment of a solid state lighting arrangement 400 comprising a flyback converter 410.

With the exception of the differences between boost converter 150 of FIGS. 3 and 4, and flyback converter 410, which will be detailed below, solid state lighting arrangement 400 is in all respects similar to solid state lighting arrangements 100, 200 and the operation of solid state lighting arrangement 400 is in all respects similar to the operation of solid state lighting arrangements 100, 200. Flyback converter 410 comprises: a two-winding inductor forming a transformer T1 with winding turns N1 and N2; a diode D1; an output capacitor C3; a sense resistor R1 and an electronically controlled switch Q1, located externally of a control circuitry 430. The winding of transformer T1 with turns N1 is referred to as the primary winding and the winding of transformer T1 with turns N2 is referred to as the secondary winding.

A first end of the primary winding of transformer T1 of flyback converter 410 is operatively connected to a wide ranging DC input source. In one embodiment the wide ranging DC input source varies from 5.5 volts DC to 28 volts DC. A second end of the primary winding of transformer T1 is connected to a first terminal of boost converter switch Q1 located externally of control circuitry 430. The second terminal of boost converter switch Q1 is connected to a sense input of control circuitry 430, denoted IBS, and to a first end of resistor R1. The control terminal of boost converter switch Q1 is connected to an output of the logic of control circuitry 430, denoted NDR. Boost converter switch Q1 is illustrated as a MOSFET, and in particular an NMOSFET, however this is not meant to be limiting in any way, and boost converter switch may be implemented with a bipolar transistor arrangement, a FET, or a PMOSFET without exceeding the scope of the invention. A second end of resistor R1 is connected to a common terminal, and to a common reference terminal input of control circuitry 430, denoted PGND.

A first end of secondary winding of transformer T1 is connected to the common terminal, a second end of the secondary winding of transformer T1 is connected to the anode of diode D1. The cathode of diode D1 represents the output of flyback converter 410, denoted $V_{LED}$, and is operatively connected to a first end of single string 40 of white LEDs across output capacitor C3. The primary and secondary windings of transformer T1 are magnetically coupled with their polarity arranged such that when boost converter switch Q1 is closed, diode D1 is reverse biased.

In operation, when boost converter switch Q1 is closed, current flows through the primary winding of transformer T1 and through boost converter switch Q1 to ground, or the common terminal via resistor R1. During this time interval, diode D1 is reverse biased and does not carry current. When boost converter switch Q1 opens, diode D1 is forward biased and conducts charging output capacitor C3. Voltage VLED is boosted from voltage VIN by the turns ratio N2/N1. Resistor R1 provides current limit protection through boost converter switch Q1, and further provides current sensing for current through boost converter switch Q1 in the event that the on-time of boost converter switch Q1 is controlled by current mode control.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described herein above. Rather the scope of the present invention is defined by the appended claims and includes both combinations and sub-combinations of the various features described hereinabove as well as variations and modifications thereof which would occur to persons skilled in the art upon reading the foregoing description and which are not in the prior art.

We claim:

1. A solid state lighting unit comprising:

a control circuitry;

a single string of light emitting diodes, said single string constituted of a plurality of sections each comprising a plurality of light emitting diodes;

a plurality of bypass paths each responsive to said control circuitry, each of said plurality of bypass paths arranged to provide bypass to a particular one of said plurality of sections; and a boost converter, said single string of light emitting diodes arranged to receive the output of said boost converter, wherein said boost converter comprises:

an inductor;

a first electronically controlled switch responsive to said control circuitry and arranged to draw current through said inductor when said first electronically controlled switch is closed; and a first diode, a first end of said first diode coupled to said inductor and said first electronically controlled switch, said first diode arranged to pass current from said inductor when said first electronically controlled switch is open, wherein said control circuitry is operative to identify an open circuit condition of a particular one of said plurality of sections, and activate said bypass path arranged to bypass said open circuit section, thereby providing light through sections not exhibiting an open circuit condition.

2. A solid stage lighting unit according to claim 1, wherein said single string of light emitting diodes is arranged such that a substantially uniform illumination is provided in the event of said open circuit condition of said particular one of said plurality of sections.

3. A solid state lighting unit according to claim 1, further comprising a current sensor in series with said single string of light emitting diodes, said control circuitry arranged to control said boost converter responsive to a current flow through said single string of light emitting diodes sensed by said current sensor.

4. A solid state lighting unit according to claim 1, further comprising a second electronically controlled switch arranged in series with said single string of light emitting diodes and responsive to an output of said control circuitry, said second electronically controlled switch enabling current flow through said single string of light emitting diodes when closed and blocking the flow of current through said single string of light emitting diodes when open.

5. A solid state lighting unit according to claim 1, wherein said inductor is constituted of a two-winding coupled inductor, and wherein a primary winding of said two-winding coupled inductor is connected to said first electronically controlled switch, and wherein said boost converter further comprises a second diode whose first end is coupled to a first end of a secondary winding of said two-winding coupled inductor; and wherein a second end of said first diode is connected to a second end of said secondary winding, and wherein said single string of light emitting diodes arranged to receive the output of said boost converter is coupled to the second end of said second diode.

6. A solid state lighting unit according to claim 5, further comprising a first capacitor and a second capacitor, a first end of said first capacitor connected to the second end of said first diode, a second end of said first capacitor connected to an electrical common point, said second capacitor connected between the first end of said first capacitor and the second end of said second diode.

7. A solid state lighting unit according to claim 1, further comprising:

a second diode;

a first capacitor; and a second capacitor, wherein said inductor is constituted of a two-winding coupled inductor, and wherein a first end of the primary winding of said two-winding coupled inductor is coupled to said first electronically controlled switch, and wherein the anode of said first diode is coupled to said first end of said primary winding and the cathode of said first diode is coupled to a first end of said secondary winding of said two-winding coupled inductor, and wherein the anode of said second diode is connected to a second end of said secondary winding of said two-winding coupled inductor, and wherein a first end of said first capacitor is coupled to the cathode of said first diode and a second end of said first capacitor is coupled to a electrical common point, and wherein said second capacitor is coupled between the cathode of said first diode and the cathode of said second diode, and wherein said single string of light emitting diodes is coupled to the cathode of said second diode thereby receiving the output of said boost converter.

8. A solid state lighting unit according to claim 1, wherein said boost converter provides a voltage in excess of 80 volts DC.

9. A solid state lighting unit according to claim 1, wherein said single string of light emitting diodes is arranged as a backlight for a liquid crystal display exhibiting a minimum diagonal dimension of 25 centimeters.

10. A solid state lighting unit according to claim 9, wherein said single string of light emitting diodes are constituted of white light emitting diodes.

* * * * *